United States Patent [19]

Wulff

[11] 4,047,375

[45] Sept. 13, 1977

[54] DARKROOM TIMER

[76] Inventor: Allan Wulff, 1351 Northgate Square, Reston, Va. 22090

[21] Appl. No.: 632,850

[22] Filed: Nov. 17, 1975

[51] Int. Cl.[2] ..... G04C 3/00; G04E 1/00

[52] U.S. Cl. ..... 58/21.13; 58/23 R; 58/38 R; 58/39.5; 58/50 R

[58] Field of Search ..... 58/21.11, 21.12, 21.13, 58/21.14, 19 R, 23 R, 38 R, 38 A, 39, 39.5, 50 R, 152 B; 340/221, 366 R, 384 E

[56] References Cited

U.S. PATENT DOCUMENTS

| | | | |
|---|---|---|---|
| 3,664,116 | 5/1972 | Emerson et al. | 58/23 R |
| 3,745,761 | 7/1973 | Tsuruishi | 58/38 R |
| 3,834,153 | 9/1974 | Yoda et al. | 58/38 R |
| 3,888,075 | 6/1975 | Wecker | 58/38 R |
| 3,946,549 | 3/1976 | Cake | 58/38 R |
| 3,949,240 | 4/1976 | Saito et al. | 58/38 R X |

*Primary Examiner*—Stanley J. Witkowski

*Attorney, Agent, or Firm*—Anthony H. Handal

[57] ABSTRACT

A highly accurate timer for timing out intervals in the order of seconds or minutes in length is disclosed. The timer comprises actuator means and digital means responsive to the actuator means for providing control signals. Coupling means provides the timer with an a.c. signal having a first characteristic periodic frequency. A clock is responsive to the coupling means to produce a series of pulses having a second characteristic frequency related to the first characteristic frequency. A counter is adapted for receiving a selectable value and is responsive to the control signals from the digital means to count pulses from the clock and produce an output when a selected value entered into the counter has been counted out. Programming means is utilized to enter a desired digital value into the counter. A switch switches a.c. power to and from external units as a function of the condition of the counter.

15 Claims, 6 Drawing Figures

NAND
210
36
FLIP FLOP
S
R
D
CK
Q
Q̄
1
2
3
4
5
6
+5V
30
32
34
FLIP FLOP
13
12
8
10
9
11
CANCEL
150
90
148
NAND
192
194
196
92
START
146
NAND
144
142
NOR
140
NOR
154
NOR
106
104
102
48
NAND
52
FOCUS
50
46
NAND

ASTABLE MULTIVIBRATOR
DECODER/DRIVER
DIVIDE BY TEN COUNTER
10 POSITION BCD CODED SWITCH
DIMMER ON/OFF
DISPLAY ON/OFF
+5V

DARKROOM TIMER

BACKGROUND OF THE INVENTION

Timing devices have been used in photographic darkrooms for such purposes as timing enlarger exposure times with sensitive photographic papers and for the precision performance of wet chemical process steps. The timing intervals used for the exposure of photographic papers are generally quite short, usually in the order of several seconds, whereas typical wet process steps, such as film and paper development, require time intervals on the order of one to several minutes.

In the past, a number of devices have been designed for aiding the measurement of time intervals in the darkroom. The most common solution to the problem of timing photographic processing steps is the spring-wound mechanical timer. Some of these timers are even provided with switches which allow them to control electrical appliances to which they are connected. However, these timers do not have any automatic means for stopping or canceling the timing period. These mechanical timers are of limited usefulness because they are generally limited to measuring time periods in either seconds or minutes. Perhaps even a more significant drawback experienced with mechanical timers is the fact that their inaccuracy often ranges as high as 10%. Moreover, although some of these devices have end alarms for sounding the end of a timing period, they do not include any means for aurally advising the user of the passage of time in the darkroom. This is especially important insofar as it is not possible to see the face of the timer in darkness. Nor is it possible to carry on an operation such as dodging or burning in a particular part of the photograph while looking at the face of the timing device.

Synchronous motor timers operating from the power line and using a conventional gear train may include a face for displaying the passage of time and means for actuating a relay. However, like spring-wound timers these timers usually time seconds or minutes functions, not both, and cannot conveniently be reset automatically. Also, the accuracy of these timers is in the order of 5%.

Still yet another approach to the problem of the timing of photographic operations is the use of an R-C network with decade switches selecting the resistance value for providing the desired timing interval in seconds for enlargement purposes. Accuracy in such a system may range between 2% and 5% depending upon the electrical circuit configuration and the precision of the components utilized. However, there is no convenient way of displaying time on these devices, and the nature of the R-C networks used makes precise timing difficult with increasing time intervals. Thus, using this sort of arrangement, the fabrication of a timer for timing periods in the order of one or several minutes is difficult and expensive to achieve with any degree of precision.

SUMMARY OF THE INVENTION

In accordance with the instant invention a versatile and accurate timing device is provided. The timer may be selectively operated in either the minutes or seconds mode. Its accuracy is in excess of 0.1%. The time interval to be timed out as well as the elapse of time is displayed on the face of the device and, additionally, the elapse of time is aurally indicated. The timer may be stopped at any time in the cycle and reset. While the timer is timing out one timing operation, the device may be reset to the next timing period which will then be automatically timed out when the timer is next actuated. The inventive timer further has means responsive to the beginning and end of the timing interval to switch power to and from a number of electrical connectors.

The timer comprises coupling means for connecting the timer to a source of a.c. power having a first characteristic periodic frequency. Digital means is responsive to an actuator to provide control signals to control the operation of the timer. A clock is connected to the coupling means and is responsive to the coupling means to produce a series of pulses having a second characteristic frequency related to the first characteristic frequency. This second characteristic frequency may be varied to change the timer between a seconds mode and a minutes mode. A counter, which includes means for allowing a selectible value to be entered into it, is responsive to the output of the clock means to count the pulses produced at the second characteristic frequency and responsive to control signals from the digital means to count pulses from the clock means and produce an output when the value entered into the counter has been counted out. A switch is responsive to the condition of the counter for controlling the application of power to one or a number of electrical connectors which may be adapted to couple power to and from desired items of darkroom equipment such as the enlarger light, safelight, automatic agitation apparatus or the like.

DETAILED DESCRIPTION OF THE PREFERRED EMBODIMENT

Figure 1A:
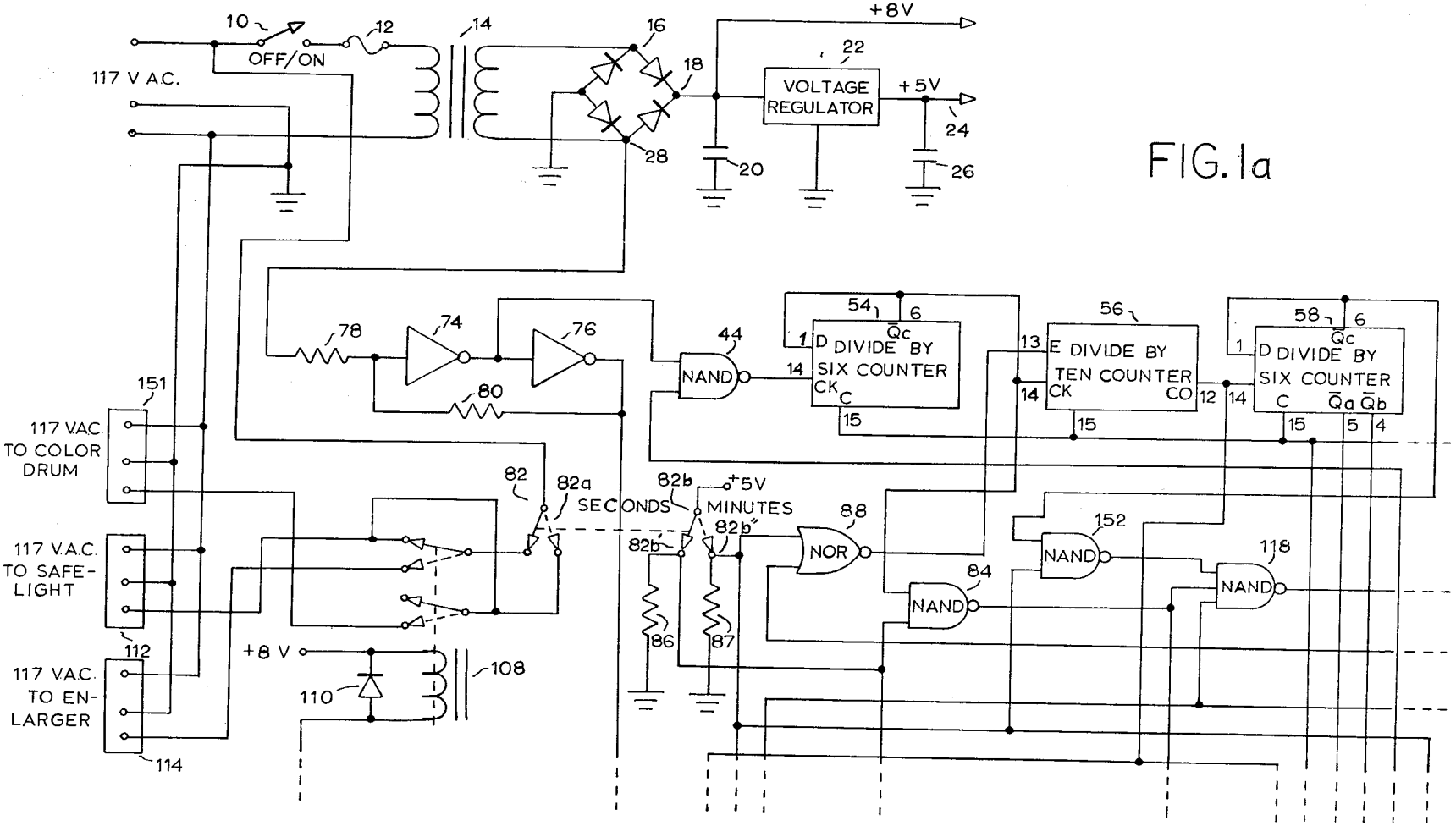
FIGS. 1*a*–1*d* together comprise a schematic diagram of a timer constructed in accordance with the present invention.
Figure 1B:
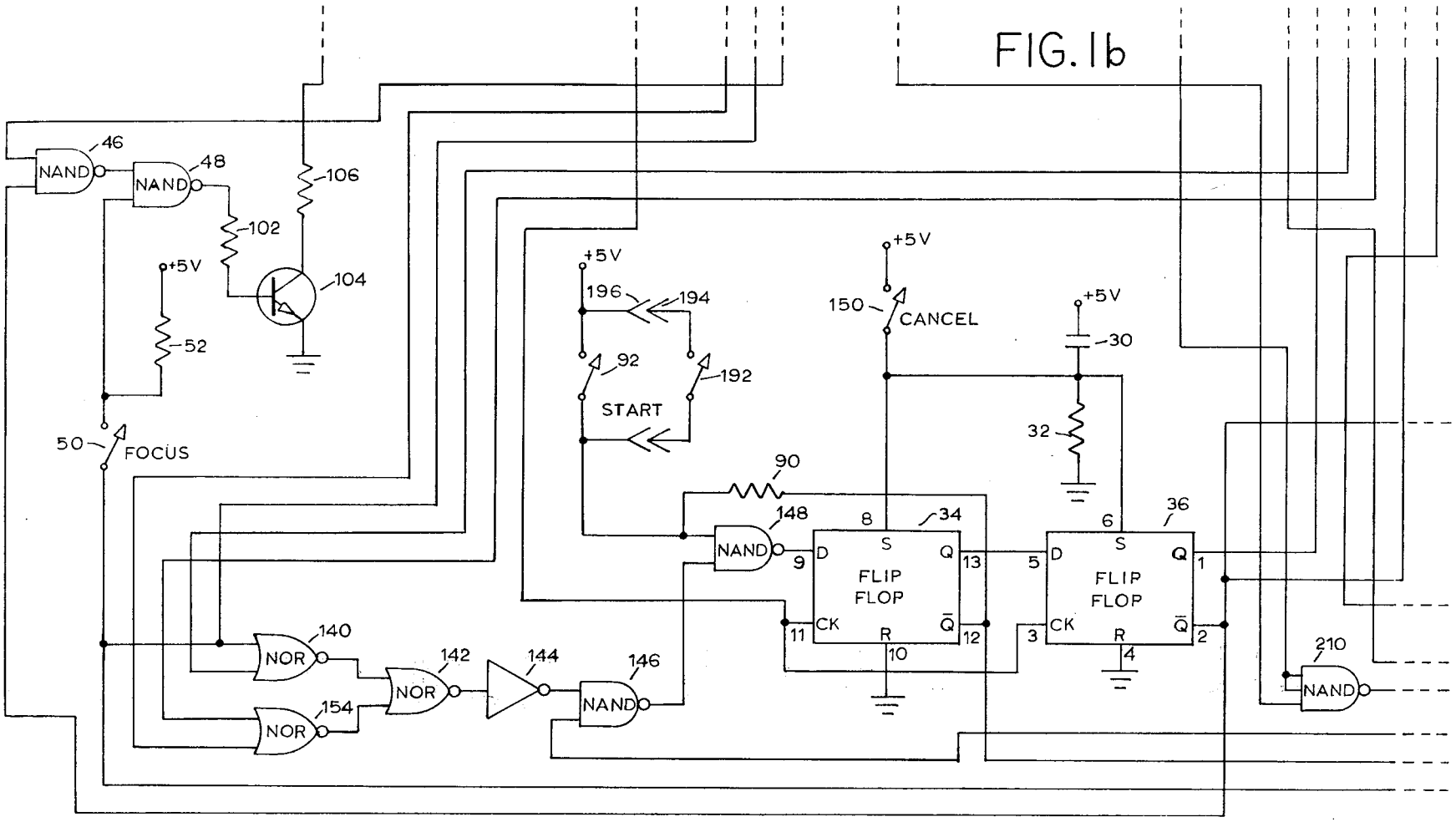
Figure 1C:
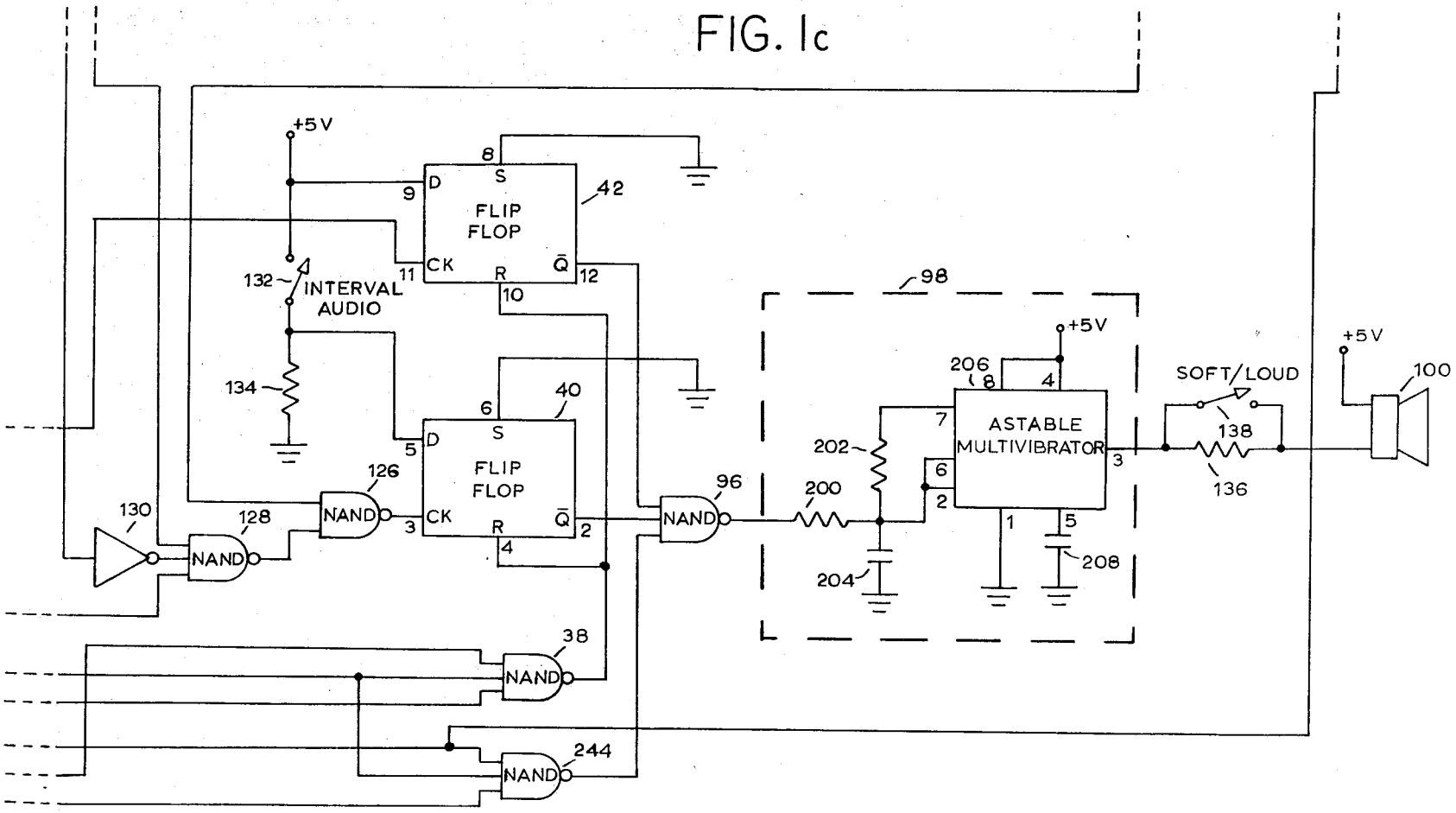
Figure 1D:
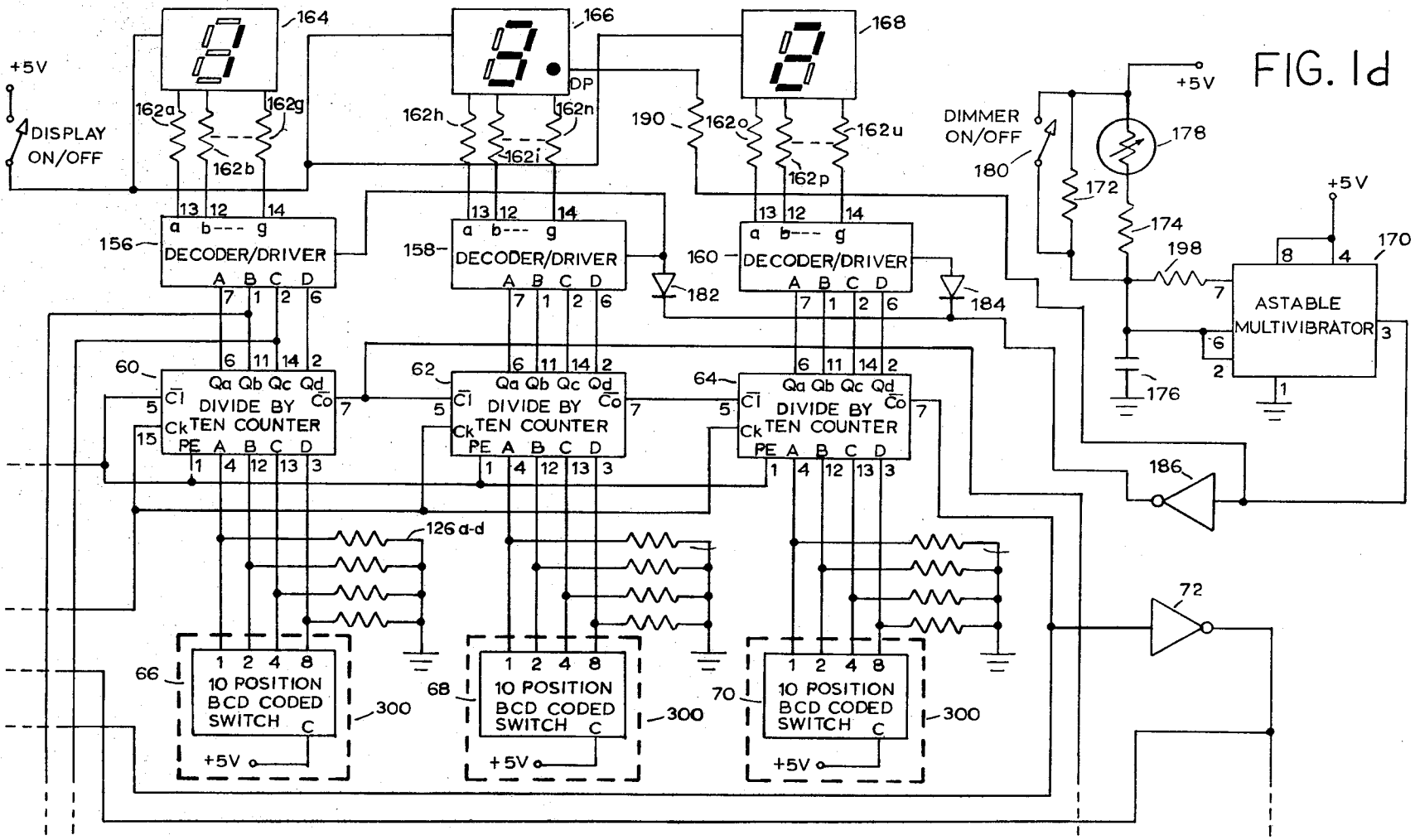

A schematic diagram of the inventive darkroom timer is illustrated in FIGS. 1*a*–1*d*, where pin numbers and alphabetical designations are indicated in standard form. Power is coupled from a standard grounded a.c. line by a switch 10 and a protective fuse 12 to the primary of a power transformer 14. The secondary of the power transformer is coupled to a conventional full-wave rectifier bridge 16 which supplies a pulsating a.c. signal at its output 18. This a.c. signal is filtered by capacitor 20 to provide an eight volt d.c. power supply voltage and then via a five volt voltage regulator 22 to a second output point 24 which serves as a five volt d.c. source. The voltage at point 24 is further stabilized by capacitor 26. Point 28 on bridge 16 serves the purpose of providing a low voltage 60 Hertz signal which serves as a frequency standard for the various timing circuits in the inventive timer.

TURN-ON AND INITIAL CONDITIONS

When power is initially turned on by the closing of switch 10, the resulting activation of the 5 volt power supply results in coupling power to the series combination of capacitor 30 and resistor 32. This causes capacitor 30 to be charged and provides a setting signal to flip-flops 34 and 36. In the preferred embodiment this setting signal will last approximately 100 milliseconds. The setting signal to flip-flops 34 and 36 during initial turn on of the timer insures that all circuits in the timer will be in the idle state when all transients have subsided.

The Q output of flip-flop 34 is low when flip-flop 34 is in the set condition. This low output is coupled to NAND gate 38. The output of NAND gate 38 is therefore high and couples a reset pulse to flip-flops 40 and 42.

When flip-flop 36 is set, its Q output is low. This output is coupled to NAND gate 44 which causes gate 44 to have a high output keeping the clock input of counter 54 high. The Q output of flip-flop 36 is also coupled to NAND gates 46 and 48, causing gate 46 to have a high output and gate 48 to have a low output, assuming that switch 50 is open, as this results in the application of a high signal to the other input of gate 48 through resistor 52 which is coupled to the 5 volt power supply. A low at the output of gate 48 coupled through resistor 102 biases transistor 104 off, causing relay 108 to be in a deenergized state. With relay 108 in a deenergized state a.c. power is coupled through switch 82 to the safelight outlet 112.

The Q output of flip-flop 36 is high when flip-flop 36 has been set, and this high output is coupled to the clear (C) inputs of counters 54, 56 and 58, thereby clearing the counters of any previous count and insuring that at the start of any count the counters will begin at the same zero count. The Q output of flip-flop 36 is also coupled to the preset enable (PE) inputs of counters 60, 62 and 64. This allows counters 60 through 64 to be preset by the binary programming switches 66, 68, and 70, respectively, independent of the clock. The high signal is also coupled to the carry input ($\overline{CI}$) of counter 60 thereby inhibiting advancement of the counters. With the carry input of counter 60 held high, the carry output ($\overline{CO}$) of the counters is prevented from going low even if the programming switches 66, 68 and 70 should be set at 000.

A Schmitt trigger consisting of inverters 74 and 76 and resistors 78 and 80 shapes the clock signal (point 28) derived from the power line into a square wave which is usable for clocking the flip-flops and counters. The ratio of resistors 78 and 80 is fixed on the order of 1–4 for proper operation of the Schmitt trigger.

COUNTING IN THE SECONDS MODE

The timer is designed to time operations and perform its control functions in either a seconds mode or a minutes mode. In the seconds mode pulses produced at the rate of 10 per second are applied from a clock generator to a set of counters. In the minutes mode, the clock output to the counters is in tenths of minutes.

When it is desired to count in the seconds mode, DPDT switch 82, having sections **82*a* and 82*b*, is put in the illustrated "seconds" position as indicated by solid lines. In this position, one of the inputs of NAND gate 84, which is normally biased low by resistor 86, is pulled high by a five volt signal that is coupled by section 82*b* of switch 82. Resistor 87 is coupled to one of the inputs of NOR gate 88 and since the CO output of counter 64 is held high, the output of inverter 72 is low, and therefore both inputs to NOR gate 88 are low and its output is high. The Data (D) input of flip-flop 34 is made the opposite of its $\overline{Q}$ output by resistor 90 and NAND Gate 148 until start switch 92** is closed.

Figure 2:
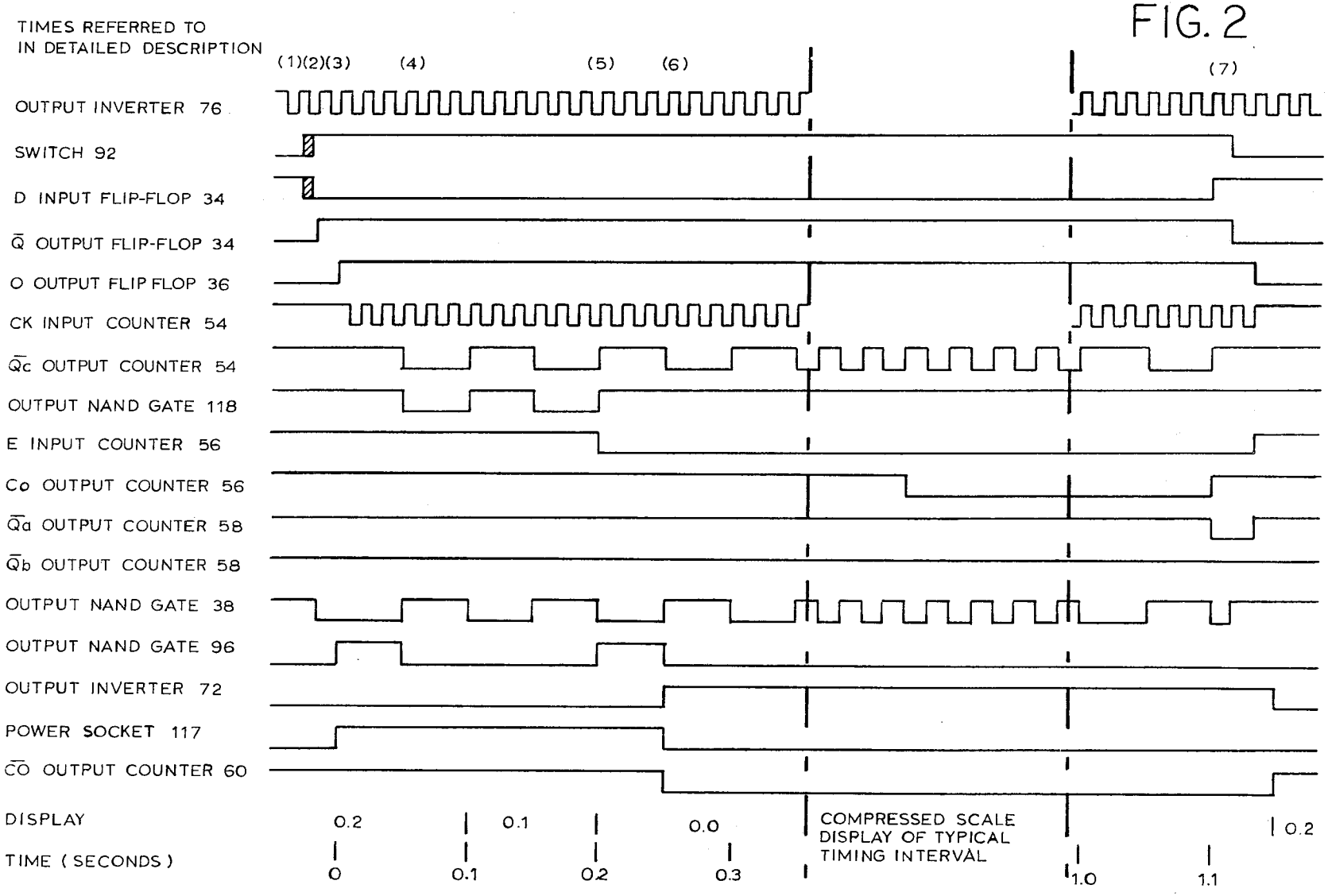
FIG. 2 is a timing chart showing the operation of the inventive timer in the seconds mode.

When a panel mounted start switch 92 is closed, the timer times the controlled operation for the time period set by switches 66, 68 and 70. In order to facilitate understanding of the circuit timing operations, outputs with respect to time of various circuit components are shown in FIG. 2. Referring to FIG. **1*b*, when switch 92 is closed, at time (1) (FIG. 2), a 5 volt signal is applied through the switch to NAND gate 148 causing the output to go low. This low output causes the (D) input of flip-flop 34 to go low causing the Q of output of flip-flop 34 to go high at the next low to high transition of the line clock output of inverter 76 (time (2) FIG. 2). Simultaneously, the Q output of flip-flop 34 goes low forcing the data (D) input of flip-flop 36 low. When the D input of flip-flop 36 goes low, the next low to high transition of the clock will cause the Q output of flip-flop 36 to go high (time (3)). Also, when the Q output of flip-flop 34 goes high, the output of NAND gate 38 goes low, allowing flip-flops 40 and 42** to be set.

When the $\overline{Q}$ output of flip-flop 36 goes high, it also starts the timing operation. This is done by the triggering of the clock input of flip-flop 42 by the $\overline{Q}$ output of flip-flop 36. This activates gate 96 and turns on oscillator 98 causing an audio tone to be emitted by speaker 100. The $\overline{Q}$ output of flip-flop 36 also drives gates 46 and 48 causing the output of gate 48 to go high. This high output is coupled via resistor 102 to transistor 104 which it drives into conduction, causing a current to flow through a resistor 106 and a relay 108. This actuates relay 108. This causes the contacts of relay 108 to move from the position shown in solid lines to the position illustrated in phantom lines, transferring power from socket 112, to which a safelight is connected, to socket 114 to which the enlarger is connected. The $\overline{Q}$ output of flip-flop 36 also enables the clock input of counter 54 by actuation of gate 44. The Q output of flip-flop 36, which is low when the $\overline{Q}$ output of the flip-flop has gone high removes the preset enable signal from counters 60, 62 and 64 and the clear signal from counters 54, 56 and 58. This isolates counters 60, 62 and 64 from the programming switches 66, 68 and 70. A low Q output of flip-flop 36 also removes power from the carry input of counter 60 to which it is coupled thereby enabling counters 60, 62 and 64 to count. The signal that is counted is the output of counter 54 which receives a pulse every sixtieth of a second through gate 44 from the output of inverter 74. Counter 54 is connected to be a divide-by-six counter and thus produces a pulse every tenth of a second. This pulse is coupled to NAND gate 84 and NAND gate 118. The enable signal to counter 56 from NOR gate 88 is still high, thus preventing it and counter 58 from counting.

The output of gate 118 is coupled to the clock inputs of counters 60, 62 and 64 thus providing a clocking pulse every tenth of a second.

Counters 60, 62 and 64 are programmable countdown decade counters and are connected in parallel clocking cascade fashion. Switches 66, 68 and 70 are conventional ten position BCD coded switches which, when set at a desired decimal number, produce the binary equivalent of that decimal at a four bit set of switch output terminals connected to the appropriate input terminals of counters 60, 62 and 64. Thus, when the preset enable signal is removed, as described above, the BCD switches provide a starting decimal number between 000 and 999 from which a count is subtracted at the frequency rate of the pulse provided by NAND gate 118. The common switch terminals are connected to the five volt supply source. Resistors 126 a-l are load resistors coupled to the inputs of counters 60, 62 and 64 and to ground. They perform the function of pulling each input to ground unless the particular line of the binary switch is closed causing the input to be held high. This arrangement effectively loads the desired values of tenths of seconds, units of seconds and tens of seconds into counters 60, 62 and 64, respectively. Thus, for example, if it is desired to have the timer time a sequence of 23.1 seconds duration, switches 66, 68 and 70 would be set to 1, 3 and 2, respectively.

As discussed above, initiation of the timing sequence causes the Q output of flip-flop 36 to go low, removing the carry input signal from counter 60. Meanwhile the $\overline{CO}$ output of counter 60 is high (unless and until the counter is at zero) and is coupled to the $\overline{CI}$ input of counter 62, preventing counter 62 from being triggered. Likewise, counter 64 is prevented from counting by the high output of counter 62 at its $\overline{CO}$ output. Every tenth of a second, when a pulse comes from gate 118, counter 60 will count down. When the number stored in counter 60 is reduced to zero, the $\overline{CO}$ output of counter 60 will go low for one count, allowing counter 62 to be triggered by the next clocking pulse. This happens at a time after the timing period has begun that is equal to the number of tenths of seconds initially programmed by switch 66. Counter 60 continues to count down as long as the timing period has not expired (which occurs when all counters reach zero) and, in the seconds mode, triggers counter 62 once every second. Counter 62 thus produces a zero at its $\overline{CO}$ output at a time equal to the sum of the tenths of seconds and units of seconds programmed into counters 60 and 62 by switches 66 and 68. As long as the timing period has not expired, counter 62 will continue to produce a pulse once every 10 seconds at its $\overline{CO}$ output. The pulses at the $\overline{CO}$ output of counter 62 are coupled to the $\overline{CI}$ input of counter 64. This causes counter 64 to register a pulse every ten seconds counting down until the entire timing period has expired.

Insofar as many photographic timing operations last only a few seconds, it is most desirable to provide a precisely spaced audio signal to indicate the passage of time. This facilitates the performance of many darkroom operations, such as dodging, burning in, etc. In the preferred embodiment, this is performed by coupling the $\overline{CO}$ output of counter 60 to the clock input of flip-flop 40 through NAND gate 126, thus pulsing it once every second when the output of counter 60 is zero. Gate 126 is also driven by the output of a NAND gate 128. Gate 128 is high since one of its inputs is kept low by resistor 87. Thus, when the binary output of counter 60 is zero, flip-flop 40 is clocked, at time (5), producing pulses at the rate of one per second provided that switch 132 is closed. This, in turn, triggers gate 96 and oscillator 98 coupled to speaker 100. If switch 132 is open, resistor 134 biases the data (D) input of flip-flop 40 low, disabling flip-flop 40. The volume of the audio signal tone produced by loudspeaker 100 may be varied by shorting resistor 136, which is in series with the loudspeaker, by closing a switch 138. Flip-flops 40 and 42 are reset through gates 210 and 38 whenever the output of counters 54 next goes low, thus making the length of the audio pulses emitted by the loudspeaker at the start of the timing sequence or each whole second from the end of the sequence one-twentieth of a second in duration, see FIG. 2, times (4) and (6).

Returning to the operation of the timing circuitry, when counters 60, 62 and 64 are all at zero the $\overline{CO}$ output of counter 64 goes low. This low signal is coupled to gate 118, causing its output to go high. This, in turn, prevents further counting by counters 60, 62 and 64. The $\overline{CO}$ output of counter 64 is also coupled to gate 46, disabling relay 108 and ending the timing sequence.

The $\overline{CO}$ output counter 64 is also coupled, via inverter 72, to gate 88 which enables counter 56 which will clock counter 58 after 0.9 seconds (FIG. 2, time 7). This will cause the Q*a* output of counter 58 to go low, which makes the output of NOR gate 140 go high, NOR gate 142 go low, inverter 144 go high, NAND gate 146 go low and NAND gate 148 go high. Thus at the next up-going edge of the output of clock inverter 76, flip-flop 34 will set. Flip-flop 36 will set at the following up-going edge. This returns all counters to the idle state by applying a clearing signal to counters 54, 56, and 58 and a preset enable signal to counters 60, 62 and 64.

The importance of this timed sequence, counter 56 counting 0.9 seconds before causing $\overline{Q}$a of counter 58 to go low, is to hold and display the 000 count in counters 60, 62 and 64 before reloading them with the program stored in switches 66, 68 and 70. This allows the darkroom operator time to visually register the counter's completed cycle before the timer is automatically made ready for a new timing sequence. Also, the reset signals from flip-flop 34 and 36 guarantee that all counters will be cleared of any residual count before a new timing operation may be started, thus insuring the extremely high accuracy of the timing sequence which is greater than 0.1%.

FOCUSING AND RESET

In the darkroom, it is often desirable to be able to turn on the enlarger independent of the timing device in order to allow the user to focus the image produced by the enlarger. When it is desired to do this, switch 50 is closed. This connects the input of gate 48, which otherwise is biased high by resistor 52, to ground via resistor 87, if switch 82 is in the position illustrated in solid lines (seconds mode). This causes the input of gate 48 to go low due to the fact that resistor 87 is much lower in value than resistor 52. If switch 82 is switched into the position illustrated in phantom lines, (minutes mode) the input of gate 48 is connected directly to the 5 volt supply and thus stays high. Switch 50 has no effect on the counting or control operation of the unit.

When, at any time, it is desired to cancel the timing sequence and return the timer to it idle state, switch 150 is closed. This sets flip-flops 34 and 36. If flip-flops 40 or 42 are active at this time, they are reset by gate 38, which is driven by the $\overline{Q}$ output of flip-flop 34.

Thus, during the timing sequence in the seconds mode, a pulse is heard from speaker 100 once every second. Before switch 92 is closed and before the timing sequence begins, relay 108 is in the idle state and power is coupled to the safe-light socket 112. When switch 92 is closed, the timing sequence begins and relay 108 is actuated for the selected period of time during which it removes power from the safe-light socket 112 and applies it to the enlarger socket 114.

At the end of the timing sequence power is removed from the enlarger socket and returned to the safe light socket. The 000 count in counters 60, 62 and 64 is held for 0.9 seconds before again loading the stored number in switches 66, 68 and 70. All counters are cleared of all residual counts before the timing sequence can begin thus insuring accuracy. The timing operation may be cancelled at any point returning the timer to the cleared, idle state. An audio tone of one-twentieth of a second duration may be heard at the start of any sequence and at each full second as the timer counts to 000.

COUNTING IN THE MINUTES MODE

When it is desired to time operations in the minutes mode, switch 82 is put in the position illustrated in phantom lines. With switch 82 in this position, the sequence by which the various logic elements in the timer are set is the same as in the seconds mode, with the exception that counters 56 and 58 are enabled. During the timing interval, power is applied to a socket 151, which may, for example, be connected to a color drum. Power is continuously provided to safe light socket 112. Counter 56 is a divide-by-ten counter and counter 58 is a divide-by-six counter. The timing sequence in the minutes mode is also initiated by the closing of switch 92, which follows the same logic path as in the seconds mode except that all audio tones are one-half second in duration. Counter 58 thus produces a pulse every six seconds, or every tenth of a minute. This pulse is coupled from the $\overline{Qc}$ output of counter 58 via a NAND gate 152 to gate 118 which drives counters 60, 62 and 64 at a rate equal to 1/60 of the rate at which they are driven in the seconds mode. Counters 60, 62 and 64, whose outputs correspond to tenths, units and tens of seconds, in the seconds mode, correspond to tenths, units and tens of minutes in the minutes mode.

The minutes timing mode is particularly useful for timing such photographic processing operations as film and paper development, fixing and the like. In operations such as this agitation may be manually performed periodically, or may be performed by an automatic drum. A convenient signal spaced periodically every 30 seconds is derived from the output of counter 60 either for the purpose of manual agitation or to advise the user audibly of the passage of time. If such an audio alarm is desired, switch 132 is closed. The Qb and Qc outputs of counter 60 are coupled via inverter 130 and gate 128 through gate 126 to flip-flop 40 which is thereby triggered whenever the value in counter 60 reaches five causing actuation of gate 96, oscillator 98 and speaker 100. Each time counter 60 reaches zero output $\overline{CO}$ goes low and this low output is coupled through gate 126 to trigger flip-flop 40 each time zero is reached. These pulses at five and zero during each minute count serve to start an alarm heard every 30 seconds. Flip-flops 40 and 42 are reset whenever the output of counter 56 is low, making the duration of the audio signal one-half of a second. This is so because the $\overline{CO}$ output of counter 56 is high at the beginning of each second and goes low one-half second later. This low is coupled through gate 38 to reset flip-flops 40 and 42 thus ending the alarm a half second after it starts until the next clock pulse received by flip-flop 40 begins the alarm again.

At the end of the timing sequence, when counters 60, 62 and 64 are all zero, the $\overline{CO}$ output of counter 64 goes low. This maintains the output of gate 118 high, preventing further counting by counters 60, 62 and 64 and, as in the seconds mode, this turns off the relay. This low signal in the $\overline{CO}$ output of counter 64 also initiates the minutes mode end of timing period alarm sequence. This alarm sequence is not dependent on the state of switch 132.

The end alarm in the minutes mode is three one-half second keyings of the audio oscillator for one-half second duration, and two one-half second periods interspersed between the keyings for a total elapsed time of two and one-half seconds. When the output of $\overline{CO}$ goes low the output of inverter 72 is high. This high is coupled to gate 244 enabling gate 96 and audio oscillator 98 each time the other inputs are high. The other input is high each time the CO output of counter 56 is high. The CO output of counter 56 is high for one half second and low for one half second thereby providing one half second pulses every second. When the $\overline{Qb}$ output of counter 58 and the CO output of counter 56 both go low, two and one half seconds after the $\overline{CO}$ output of counter 64 went low, gate 154 will go high, gate 142 low, inverter 144 high, gate 146 low and gate 148 high, causing flip-flops 34 and 36 to reset on the next two positive edges of the output of inverter 76 causing the unit to return to the idle state ceasing the alarm. The delay of 2.5 seconds is sufficient to allow the device to provide three one-half second pulses from loudspeaker 100.

In the minutes mode the timer displays the 000 count for two and one half seconds before displaying the program values held by switches 66, 68 and 70. As in the seconds mode, the reset signal from flip-flops 34 and 36 insures that there are no residual values left in counters 54, 56 and 58 and that they are clear and ready for the next timing sequence insuring timing accuracy greater than 0.1 percent.

Thus, in the minutes mode, prior to actuation of switch 92, relay 108 couples a.c. power only to safelight socket 112. When switch 92 is closed power is maintained at socket 112 and coupled also to socket 151 by relay 108. At the end of the timing sequence, power is removed from socket 151 as the relay resumes its idle state. During timing, a pulse is heard every thirty seconds if switch 132 is closed. Regardless of the state of switch 132, at the end of the timing sequence three pulses are heard.

DISPLAY

The numbers stored in counters 60, 62 and 64 are coupled to display drivers 156, 158 and 160 which in turn are coupled via resistors 162 a–u to drive seven-segment light emitting diode displays 164, 166 and 168, respectively. Thus, when the device is at idle the time period which will be timed out by the timer is displayed by displays 164, 166 and 168. During the timing sequence, the displays will display the amount of time remaining in the time period. During the timing sequence, a new number may be set on switches 66, 68 and 70 but it will not be loaded into counters 60, 62 and 64 until the timing and end delay sequence is completed because a low is held at the preset enable of the counters. When flip-flops 34 and 36 are reset; the preset enable high is restored transferring the preset number to the counters.

Brightness of the display is controlled by applying a variable duty cycle pulse train to the blanking input (BI) of display drivers 156, 158 and 160. The purpose of controlling brightness is to make the display brighter under relatively high intensity lighting conditions and to make the display dimmer under relatively poor lighting conditions. The variable duty cycle pulse train is provided by an astable multivibrator 170. Such a multivibrator may be obtained in a single integrated circuit package. The duty cycle of multivibrator 170 depends on the value of externally connected resistors 172, 174 and 198, and photoresistor 178 whose resistance is a function of the incident ambient light intensity to which it is exposed. The dimming circuit may be disabled by closing switch 180 which is connected across the series parallel combination of the photoresistor 178 and resistors 172 and 174. The varying resistance of the photoresistor in series with the capacitor causes the capacitor to charge and discharge at different rates. The display brightness is at its brightest under daylight or normal room light conditions. It is subdued under photographic safelight conditions and at its dimmest under total darkness. The output of the multivibrator 170 is coupled via inverter 186 and blocking diodes 182 and 184 to the blanking inputs of the display drivers 156, 158, and 160. Similarly, the decimal point in display 168 is coupled to the output of oscillator 170 via resistor 190. The display may be turned off by switch 188, removing the 5 volt supply from the displays.

By way of example, the inventive timer may be constructed using the following components in the circuit illustrated in FIGS. 1*a*–1*d*.

| | |
|---|---|
| Resistor 32 | 2.2 megohm |
| Resistor 52 | 100 kilohms |
| Resistor 78 | 100 kilohms |
| Resistor 80 | 390 kilohms |
| Resistor 86. | 10 kilohms |
| Resistor 87 | 10 kilohms |
| Resistor 90 | 10 kilohms |
| Resistor 102 | 3.3 kilohms |
| Resistor 106 | 10 ohms |
| Resistor 126a-1 | 10 kilohms |
| Resistor 134 | 10 kilohms |
| Resistor 136 | 22 ohms |
| Resistors 162a-μ | 100 ohms |
| Resistor 172 | 100 kilohms |
| Resistor 174 | 47 ohms |
| Resistor 190 | 150 ohms |
| Resistor 198 | 680 ohms |
| Resistor 200 | 270 kilohms |
| Resistor 202 | 47 kilohms |
| Capacitor 20 | 2,000 microfarads at 25 volts |
| Capacitor 26 | 200 microfarads at 10 volts |
| Capacitor 30 | .05 microfarads |
| Capacitor 176 | .05 microfarads |
| Capacitor 204 | .01 microfarads |
| Capacitor 208 | .05 microfarads |
| Transistor 104 | 2N3643 |
| Diodes in bridge 16 and 110 | IN4001 |
| Diodes 182, 184 and 302 a–h | IN4148 |
| Transformer 14 | 8 volts at 800 ma. |
| Photoresistor 178 | 450 ohms at 2 foot candle, 120 kilohms Dark resistance (Clairex type CL5P4L) |
| Speaker 100 | 8 ohms, ½ watt |
| Relay 108 | 200 ohms; 30 ma. at 6 volts DC |
| Voltage regulator 22 | LM 340T-5 |
| Counters 54 and 58 | CMOS 4018 - Presettable Divide-By-"n" Counter |
| Counter 56 | CMOS 4017 - Decade Counter/Divider |
| Counters 60, 62 & 64 | CMOS 4029 - Presettable Up/Down Binary Decade Counter |
| Decade Decoders 156, 158 & 160 | TTL 74L47 |
| Astable Multivibrators 206 & 208 | 555 Timer |
| Inverters 72, 74, 76, 130, 144 and 186 | CMOS 4009 - Hex Buffers/Converters |
| Gates 44, 46, 48, 84 126, 146, 148 and 152 | CMOS 4011 - Two input NAND Gates |
| Gates 38, 96, 118, 128, 210 & 244 | CMOS 4023 - Three input NAND Gates |
| Gates 88, 140, 142 & 154 | CMOS 4001 - Two input NOR Gates |
| Flip-Flops 34, 36, 40 & 42 | CMOS 4013 - Dual D-type Edge Triggered Flip-Flops |
| Fuse 12 | ½ amp |
| Displays 164, 166 & 168 | 7 Segment, common anode LED Displays, Righthand D.P. |
| Switches 66, 68, 70, 304 and 306 | 10 position, BCD Coded |

Figure 3:
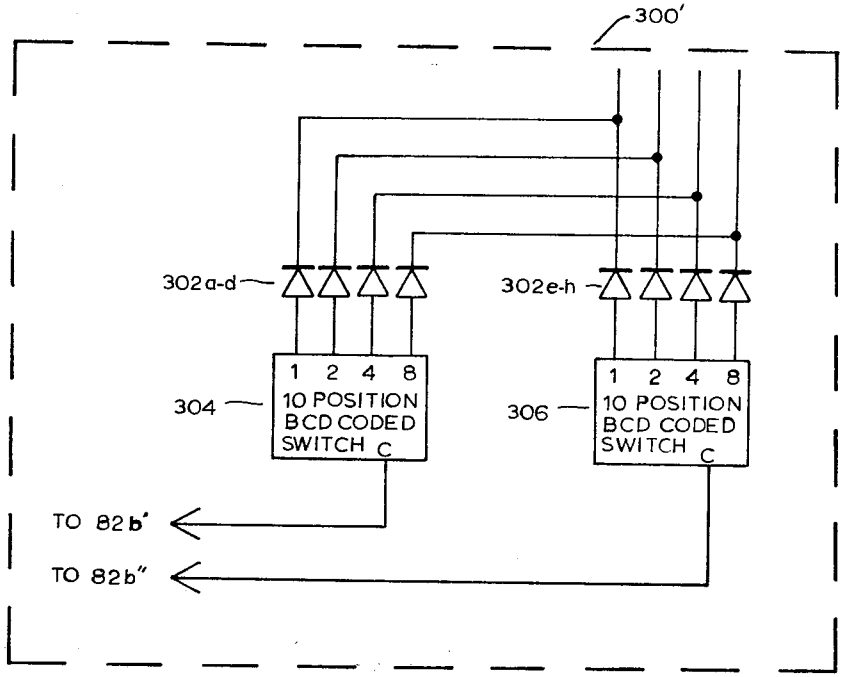
FIG. 3 is a schematic representation of a modification of the timer illustrated in FIGS. 1*a*–1*d*.

It is possible to provide separate programming sources for the minutes and seconds mode for counters 60, 62 and 64. If this is desired programming source 300' in FIG. 3 is substituted for sources 300 in FIG. 1*d*. The separate program sources, comprising two switches with blocking diodes allow the operator to operate more rapidly between the minutes and seconds mode. The common terminal of switch 304 is connected to switch terminal 82*b*' (seconds mode) thus selectively providing a 5 volt signal through blocking diodes 302 *a–d* to counter inputs A, B, C, and D as a function of the position of the BCD code. Resistors 125 would still act as load resistors pulling open switch terminals low. The blocking diodes 302 *e–h* on switch 306 would insure that all terminals of that switch would be seen by the counter as an open circuit. Switch 306 would be held low by resistor 87 through terminal 82*b*". In the minutes mode switch 304 is held low through resistor 86 and terminal 82*b*' and switch 306 is held high through terminal 82*b*". Thus switch 306 provides its inputs to the counters.

While illustrative embodiments of the invention have been described, it is of course understood that various modifications may made by those skilled in the art without departing from the spirit and scope of the invention. For example a foot switch 192 may be substituted for the panel start switch 92 and connected by a plug 194 and a socket 196. A logic series other than CMOS, TTL for example, might be substituted to build the inventive device. Such modifications are within the spirit and scope of the invention as defined by the following claims.

I claim:

1. A timer for switching power to and from an external unit, comprising:

a. actuator means;

b. digital means responsive to said actuator means for providing control signals;

c. coupling means for providing the timer with a periodic signal having a first characteristic frequency;

d. clock means responsive to said coupling means to produce a series of pulses having a second characteristic frequency related to said first characteristic frequency;

e. counter means adapted for receiving a desired selectable digital value, said counter means being responsive to said control signals from said digital means to count pulses from said clock means and produce an output when a digital value entered into said counter means has been counted out;

f. programming means for entering a desired selectable digital value into said counter means; and g. switch means responsive to said counter means for switching power to and from an external unit as a function of the condition of said counter means.

2. A timer as in claim 1, wherein said counter means comprises a plurality of counters successively connected in a cascade configuration, each of said counters having first and second enabling inputs and a clocking input, the first of said enabling inputs on each of said counters being connected to an enabling output on said digital means, said enabling output of said digital means producing an enabling signal when said digital means is actuated, the first of said counters having its second enabling input connected to an enabling output of said digital means and each successive digital counter having its second enabling input connected to an enabling output on the preceding digital counter which produces an enabling signal when the number in said preceding counter is zero whereby said successive counter is pulsed when the selectable value stored in said counter has been counted out and when the counter is subsequently cycled through its full capacity.

3. A timer as in claim 2, further comprising means responsive to said counter means for detecting when all of said counters have counted out the values stored in them by said programming means and for actuating said digital means to cause said counter means to cease counting.

4. A timer as in claim 3, further comprising audio means responsive to said clock means for producing a periodic audio signal related to said first and second characteristic frequencies.

5. A timer as in claim 4, wherein said switch means is a relay.

6. A timer as in claim 4, wherein said digital means causes said counter means to cease counting by stopping said clock means from producing pulses.

7. A timer as in claim 4, wherein said second characteristic frequency may be varied between at least two values.

8. A timer as in claim 1, further comprising audio means responsive to said clock means for producing a periodic audio signal related to said first and second characteristic frequencies.

9. A timer as in claim 1 wherein said digital means is responsive to the application of power to the timer to generate a clearing signal to clear the counter means of any number which may be stored therein.

10. A timer as in claim 1 wherein said clock means continues to produce pulses at the end of a timing period whereby said pulses provide timing information for an end of interval alarm.

11. A timer as in claim 1 wherein the digital means is responsive to a switch to cause the counting means to cease counting and the clock to cease producing pulses and to clear the counter of any digital value contained therein whereby the timer returns to its steady state.

12. A timer as in claim 1 further comprising display means coupled to said counter means for displaying the value stored in said counter means.

13. A timer as in claim 12 where said display means comprises a light emitting alpha-numeric display.

14. A timer as in claim 13 wherein the intensity of the light emitted by said alpha-numeric display is controlled by photosensitive means, said photosensitive means being exposed to ambient light conditions to increase the brightness of said alpha-numeric display under bright light conditions and to decrease the brightness of said display under attenuated lighting conditions.

15. A timer for switching power to and from a unit, comprising:

a. actuator means;

b. digital means responsive to said actuator means for providing control signals;

c. coupling means for providing the timer with a periodic signal having a first characteristic frequency;

d. clock means responsive to said coupling means to produce a series of pulses having a characteristic frequency related to said first characteristic frequency;

e. counter means adapted for receiving a desired selectable digital value, said counter means being responsive to said control signals from said digital means to count pulses from said clock means and produce an output when a digital value entered into said counter means has been counted;

f. programming means for entering a desired selectable digital value into said counter means;

g. switch means responsive to said counter means for switching power to and from the unit as a function of the condition of said counter means;

h. audio means responsive to said clock means for producing a periodic audio signal related to said first characteristic frequency; and i. display means coupled to said counter means for displaying the value stored in said counter means.

* * * * *